United States Patent [19]

Steklenski et al.

[11] Patent Number: 4,542,095

[45] Date of Patent: Sep. 17, 1985

[54] ANTISTATIC COMPOSITIONS COMPRISING POLYMERIZED ALKYLENE OXIDE AND ALKALI METAL SALTS AND ELEMENTS THEREOF

[75] Inventors: David J. Steklenski; Jon E. Littman, both of Rochester, N.Y.

[73] Assignee: Eastman Kodak Company, Rochester, N.Y.

[21] Appl. No.: 633,998

[22] Filed: Jul. 25, 1984

[51] Int. Cl.[4] ..... G03C 1/78

[52] U.S. Cl. ..... 430/527; 428/201; 428/393; 430/523; 430/271; 430/536; 430/637

[58] Field of Search ..... 430/527, 530, 637, 631, 430/271, 523; 252/8.6, 8.9; 428/201, 393

[56] References Cited

U.S. PATENT DOCUMENTS

| | | | |
|---|---|---|---|
| 4,272,616 | 6/1981 | Kishimoto | 430/530 |
| 4,294,759 | 10/1981 | Upsen et al. | 430/527 |
| 4,330,618 | 5/1982 | Minamizono et al. | 430/527 |
| 4,358,533 | 11/1982 | Tokitou et al. | 430/527 |
| 4,382,990 | 5/1983 | Coates | 252/8.6 |
| 4,426,300 | 11/1984 | Dexheimer et al. | 252/8.9 |

*Primary Examiner*—Jack P. Brammer

*Attorney, Agent, or Firm*—John R. Everett

[57] ABSTRACT

Antistatic compositions are disclosed comprising a binder and a nonionic surface-active polymer having polymerized alkylene oxide monomers and an alkali metal salt characterized in that the composition is heterogeneous, comprises on a dry basis, at least 7 weight percent polymerized alkylene oxide monomers and the binder is selected from the group consisting of a particulate material and a mixture of particulate materials with hydrophilic materials.

15 Claims, No Drawings

ANTISTATIC COMPOSITIONS COMPRISING POLYMERIZED ALKYLENE OXIDE AND ALKALI METAL SALTS AND ELEMENTS THEREOF

FIELD OF THE INVENTION

The present invention relates to antistatic compositions and elements containing these compositions, including photographic elements. More specifically, the present invention relates to antistatic compositions comprising binders, polymerized alkylene oxide, alkali metal salts and their use as antistatic layers in a variety of elements, including photographic elements.

BACKGROUND OF THE INVENTION

The unwanted build-up of static electricity on an insulated support is well known. This phenomenon occurs on any element having an insulating support surface.

In photographic elements, including electrophotographic elements, radiation-sensitive layers are usually coated on an insulating support. It has been the practice to reduce the electrostatic charge build-up by coating the surface of the support on which no photosensitive layers are coated with an antistatic composition. The latter surface is referred to herein as the back surface of the support.

In U.S. Pat. No. 4,272,616 the back surface is coated with a homogeneous antistatic composition comprising a hydrophilic binder, such as gelatin, containing a nonionic polyethylene oxide surface-active agent and an alkali metal thiocyanate, iodide, perchlorate or periodate. Such antistatic compositions are effective in reducing the surface resistivity of such supports to about $10^{11}$ ohms/sq at 30% relative humidity (RH). However, according to the patent, even at resistivities of $10^{11}$ some static marks are discernable in developed photographic elements in which such antistatic coatings are used. The appearance of such static marks indicates that it is desirable to reduce the surface resistivity of such photographic supports even lower.

SUMMARY OF THE INVENTION

The present invention provides an antistatic composition comprising a binder and a nonionic surface-active polymer having polymerized alkylene oxide monomers and an alkali metal salt characterized in that the composition is heterogeneous, comprises on a dry basis, at least 7 weight percent polymerized alkylene oxide monomers and the binder is selected from the group consisting of a particulate binder and a mixture of a particulate material with a hydrophilic material. By particulate it is meant the binder is water-insoluble.

Such compositions, when coated on insulating surfaces reduce the resistivity thereof as much as four orders of magnitude more than the same antistatic compositions in which a dissolved hydrophilic binder is used. In other words, the use of a particulate binder unexpectedly has a significant impact in decreasing the resistivity of the antistatic compositions of this invention. It is believed that the particulate material forces a phase separation of the poly(alkylene oxide) with a resulting enhancement of conductivity.

Alkylene refers to divalent hydrocarbon groups having 2 to 6 carbon atoms such as ethylene, propylene and butylene.

In one aspect, the present invention provides an antistatic composition comprising a binder and a nonionic surface-active polymer having polymerized ethylene oxide monomers and an alkali metal salt characterized in that the composition is heterogeneous, comprises at least 7 weight percent poly(ethylene oxide) monomers and the binder is selected from the group consisting of a particulate material and a mixture of a particulate material with a hydrophilic material.

In another aspect, the present invention provides elements, particularly photographic elements comprising layers of the antistatic compositions of the present invention.

DETAILS OF THE INVENTION

The heterogeneous antistatic compositions of the present invention are generally prepared by combining the binder consisting of an aqueous latex composition containing hydrophobic polymer particles, other particulate materials, or a mixture of the particulate material and a hydrophilic material with an aqueous solution of the nonionic surface-active polymer having the polymerized alkylene oxide monomers and an aqueous solution of the selected alkali metal salt. The resulting antistatic composition can be coated on insulating supports to reduce the resistivity of the support.

Useful particulate material for use as binders in the heterogeneous antistatic compositions are selected from the many known photographically useful latex compositions containing hydrophobic polymer particles and from inorganic and nonpolymeric hydrophobic particulate material. The weight percent of the particulate binder in the dry antistatic composition is preferably 40 weight percent up to about 92 weight percent.

Useful latex compositions are, in general, as described in *Research Disclosure,* Item 19551, July 1980, published by Kenneth Mason Publications, Ltd. The Old Harbourmaster's, 8 North Street, Emsworth, Hampshire P010 7DD, England. They include poly(acrylate), polymethacrylate, polystyrene, acrylamide polymers, polymers of alkyl and sulfoalkyl acrylates and methacrylates, methacrylamide copolymers, acryloyloxyalkanesulfonic acid copolymers, sulfoalkylacrylamide copolymers and halogenated styrene polymers etc.

Examples of useful nonpolymeric particulate material includes colloidal silica, titanium dioxide, glass beads, barium sulfate and colloidal alumina.

When the binder is a mixture of a particulate material with a hydrophilic material, the antistatic compositions of the invention are coatable in simultaneous multilayer coating processes used in the manufacture of photographic film. Such mixtures generally comprise 40 to 67 weight percent of hydrophilic material and 33 to 60 weight percent of particulate material.

Suitable hydrophilic materials include both naturally occurring substances such as proteins, protein derivatives, cellulose derivatives, e.g. cellulose esters, gelatin, e.g. alkali-treated gelatin (cattle bone or hide gelatin) or acid-treated gelatin (pigskin gelatin), gelatin derivatives, e.g. acetylated gelatin, phthalated gelatin and the like, polysaccharides such as dextran, gum arabic, zein, casein, pectin, collagen derivatives, collodion, agar-agar, arrowroot, albumin, colloidal albumin or casein, etc.; cellulose or hydroxyethyl cellulose, etc.; and synthetic hydrophilic colloids such as poly(vinyl alcohol), poly-N-vinylpyrrolidone, poly(acrylic acid) copolymers, polyacrylamide or derivatives of them or partially hydrolyzed products of them, etc. If necessary, mixtures of two or more of these colloids are used. Among them, the most useful one is gelatin. The gelatin used here includes the so-called lime treated gelatin, acid treated gelatin and enzyme treated gelatin.

Any nonionic surface-active polymer including homopolymers and copolymers comprising polymerized alkylene oxide monomers will be useful. Useful nonionic surface-active polymers containing blocks of polymerized alkylene oxide monomers are disclosed in U.S. Pat. Nos. 2,917,480, 4,272,616, 4,047,958 and Japanese patent application Nos. 55/70837 and 52/16224. Particular preferred polymers include the Igepal® surfactants sold by GAF Corp. such as Igepal® CO-630 and Igepal® CO-997 which are nonylphenoxypoly(ethoxy)ethanols; Triton® X-100. an octylphenoxypoly(ethoxy)ethanol sold by Rohm and Haas Co.; the Pluronic® surfactants sold by BASF Wyandotte Corp. such as Pluronic® 10R5 and Pluronic® 25R3 surfactants which are poly(ethylene oxide-blockpropylene oxide) block copolymers; Renex® 30, a poly(ethylene oxide) ether alcohol sold by ICI Americas, Inc.; and Brij® 76, a stearylpoly(ethylene oxide) sold by Atlas Chemical Industries, N.V. Other useful polymers include polymerized monomers of propylene oxide and butylene oxide. The antistatic composition must comprise at least 7 weight percent polymerized alkylene oxide monomers.

Useful alkali metal salts include alkali metal nitrates, alkali metal tetrafluoroborates, alkali metal perchlorates, alkali metal thiocyanates, alkali metal halides, etc. Alkali refers to sodium, lithium, potassium etc. The preferred salts are lithium salts with $LiNO_3$ and $LiBF_4$ being most preferred. The antistatic composition generally comprises from 1 to 8 weight percent of the alkali metal salt.

The weight percent solids of the heterogeneous, antistatic compositions of the present invention used in a coating can vary widely. The percent solids, along with the method of coating, has a substantial influence on the coverage of the layer that results from any coating composition. By "solids" in this context we mean the suspended particulate material. A useful range for the weight percent solids in the coating composition is between about 0.2 percent and about 40 percent.

The compositions can be coated on a wide variety of supports to form a wide variety of useful antistatic elements. The support can take a number of different forms. For example, the compositions can be coated on polymeric materials such as poly(ethylene terephthalate), cellulose acetate, polystyrene, poly(methyl methacrylate) and the like. The compositions can also be coated on other supports such as glass, paper including resin-coated paper, and metals. Fibers including synthetic fibers, useful for weaving into cloth, can be used as the support. Planar supports such as polymeric films useful in photography are particularly useful. In addition, the compositions of the present invention can be coated onto virtually any article where it is desired to decrease resistivity. For example, the compositions an be coated on small plastic parts to prevent the unwanted buildup of static electricity or coated on small polymeric spheres or other shapes such as those used for toners in electrography and the like.

The compositions of the present invention can be coated onto the support using any suitable method. For example, the compositions can be coated by spray coating, fluidized bed coating, dip coating, doctor blade coating or extrusion hopper coating, to mention but a few.

In some embodiments, it may be desirable to coat the layer of the antistatic compositions of the present invention with a protective layer. The protective layer can be present for a variety of reasons. For example, the protective layer can be an abrasion-resistant layer or a layer which provides other desirable physical properties. In many embodiments, for example, it can be desirable to protect the layers of the antistatic composition from conditions which could cause the leaching of one of the components. Where the antistatic layer of the present invention is part of an element having an acidic layer, it can be desirable to provide a barrier in the form of a protective layer to prevent the contact of the antistatic layer by base. The protective layer is typically a film-forming polymer which can be applied using coating techniques such as those described above for the conductive layer itself. Suitable film-forming resins include cellulose acetate, cellulose acetate butyrate, poly(methyl methacrylate). polyesters, polycarbonates and the like.

The coating compositions of the present invention are particularly useful in forming antistatic layers for photographic elements. Elements of this type comprise a support having coated thereon at least one radiation-sensitive layer. While layers of the antistatic composition can be in any position in the photographic element, it is preferred that the layers be coated on the photographic support on the side of the support opposite the side having the coating of the radiation-sensitive material. The antistatic compositions are advantageously coated directly on the support which can have a thin subbing layer as is known in the art, and may then be overcoated with the described protective layer. Alternatively, the antistatic layers can be on the same side of the support as the radiation-sensitive material and the protective layers can be included as interlayers or overcoats, if desired.

The radiation-sensitive layers of the photographic or electrophotographic elements of the present invention can take a wide variety of forms. The layers can comprise photographic silver salt emulsions, such as silver halide emulsions; diazo-type compositions; vesicular image-forming compositions; photopolymerizable compositions; electrophotographic compositions comprising radiation-sensitive semiconductors; and the like. Photographic silver halide emulsions are particularly preferred and are described, for example, in *Product Licensing Index,* Publication 9232, Vol. 92, Dec. 1971, pages 107–110.

The resistance of the surface of the coatings of the present invention can be measured using well known techniques. The resistivity is the electrical resistance of a square of a thin film of material measured in the plane of the material between opposite sides. This is described more fully in R. E. Atchison, *Aust. J. Appl. Sci.,* 10, (1954).

By practicing the present invention, the problems caused by static charges generated in production and use of elements having electrically insulating surfaces are significantly diminished. For example, the occurrence of static marks caused by contact between the emulsion face and the back face of the photographic sensitive material, contact of one emulsion face with another emulsion face and contact of the photographic sensitive material with other materials such as rubber, metal, plastics and fluorescent sensitizing paper and the like is remarkably reduced by practicing the present invention.

Moreover, the compositions of this invention effectively prevent static charges generated in setting films in cassettes, in loading films in cameras or in taking many photographs continuously at a high speed by an automatic camera such as those used in X-ray films.

The following examples will serve to illustrate the practice of this invention and to compare it to the prior art homogeneous antistatic compositions containing hydrophilic binders. However, the present invention is not to be construed as being limited to these examples.

EXAMPLE 1

An aqueous antistatic composition was prepared by first mixing the particulate binder, 7.9 gm methyl methacrylate latex (42.5% solids) and 1.8 gm butyl methacrylate latex (46.5% solids) with 74.3 ml $H_2O$. Eight ml of 10% wt/vol poly(ethylene oxide) (mol. wt. 1450, Eastman Kodak Company) and 8.0 ml of 5% wt/vol $LiNO_3$ were added to the latex dispersion to form the heterogeneous antistatic composition. The dried composition contained on a weight to weight basis 77.7% particulate binder; 7.4% $LiNO_3$ and 14.89% poly(ethylene oxide).

The heterogeneous composition was applied to a subbed polyester support at a wet coverage of 11 $mg/m^2$ and dried at a temperature of 100° C. to remove the water. The layer was colorless and gave surface resistivity values of $3\times10^8$ ohm/sq at 50% RH and $2\times10^9$ ohm/sq at 25% RH.

The antistatic composition was coated in the same manner onto a polyethylene-coated, coronadischarge-treated, paper support and a colorless layer was obtained having resistivities of $2.5\times10^8$ ohm/sq at 50% RH and $1.8\times10^9$ ohm/sq at 25% RH.

The above resistivity values represent unexpected improvement over antistatic compositions of U.S. Pat. No. 4,272,616 containing the same ratio of components. Resistivities of $10^{11}$ ohm/sq at 30% relative humidity were obtained with the latter homogeneous antistatic compositions.

EXAMPLE 2

This example demonstrates the effect of changes in the concentration of particulate binder on coating resistivity compared to prior art results of Example 3 infra. A series of coatings was prepared on a film support as in Example 1. In each case, the amount of poly(ethylene oxide) was 0.67 gm and $LiNO^3$ was 0.33 gm as in Example 1, while the amount of latex binder was varied from 67 to 83.3 weight percent of the composition to establish the effect of particulate binder variations on conductivity. The compositions were coated and dried as in Example 1. The dry weight percent of the composition components and resistivity value obtained for each composition are shown in Table I.

TABLE I

| Weight Percent of Components | | | | |
|---|---|---|---|---|
| Particulate Binder | Poly(ethylene oxide) | $LiNO_3$ | Binder Weight | Coating Resistivity (ohm/sq) at 40% RH |
| 67 | 22 | 11 | 2.0 gm | $7.7\times10^7$ |
| 75 | 16.75 | 8.25 | 3.0 gm | $1.4\times10^8$ |
| 80 | 13.4 | 6.6 | 4.0 gm | $1.3\times10^8$ |
| 83.3 | 11.2 | 5.5 | 5.0 gm | $1.3\times10^8$ |

EXAMPLE 3

This example consists of coatings made by the teachings of the prior art as disclosed in U.S. Pat. No. 4,272,616, using hydrophilic polymers as binders instead of the particulate binders of this invention. A series of coating solutions was prepared in which the amounts of poly(ethylene oxide) and $LiNO_3$ were kept constant at levels equal to those in Example 2 and either gelatin (Type IV, Eastman Kodak Company) or poly(vinyl alcohol) (PVA from E. I. DuPont) was used as the binder in varying amounts as in Example 2. The solutions were coated on a subbed film support and dried as in Example 2. The surface resistivity measurements are shown in Table II.

TABLE II

| Weight Percent of Homogenous Binder | Surface Resistivity (ohm/sq) at 40% RH | |
|---|---|---|
| | Gelatin Binder | PVA Binder |
| 67 | $1\times10^{11}$ | $2.8\times10^9$ |
| 75 | $5.3\times10^{11}$ | $2.1\times10^{10}$ |
| 80 | $1.8\times10^{12}$ | $9.1\times10^{10}$ |
| 83 | $>10^{12}$ | $8.3\times10^{10}$ |

A comparison of these results with those shown in Table I clearly demonstates the significant decrease in resistivity obtained by the practice of this invention.

EXAMPLE 4

An antistatic composition was prepared by mixing the particulate binder, 14.0 gm of 20% wt/wt Wesol ® P (colloidal silica from Wesolite Corp.) with 74.2 ml $H_2O$, 4.0 ml 10% $LiNO_3$ and 8.0 ml 10% poly(ethylene oxide). The dispersion was coated on subbed film support and dried as in Example 1 to give a coating having a resistivity of $2.6\times10^9$ ohm/sq at 30% RH. The dry composition contained on a weight to weight basis, 70% silica, 10% $LiNO_3$ and 20% poly(ethylene oxide).

EXAMPLE 5

A series of coatings on a subbed film support was prepared by the method of Example 1. In this series, however, $LiNO_3$ was used with several different poly(ethylene oxide) containing surface-active materials. The concentrations of the various composition components are constant. A comparison of the surface resistivity values obtained using the particulate hydrophobic latex binders of Example 1 with the poly(vinyl alcohol) binder (PVA) of Example 3 is shown in Table III.

TABLE III

| Surfactant | Surface Resistivity at 35% RH (ohm/sq) | |
|---|---|---|
| | Particulate Latex Binder | PVA Hydrophillic Binder |
| Igepal ® CO-630 | $1.6\times10^8$ | $3\times10^{10}$ |
| Igepal ® CO-997 | $1.5\times10^8$ | $7.7\times10^{10}$ |
| Triton ® X-100 | $1.4\times10^8$ | $4.5\times10^{10}$ |
| Pluronic ® 25RB | $1.9\times10^8$ | $1.5\times10^{11}$ |
| Renex ® 30 | $9.1\times10^7$ | $>10^{12}$ |
| Brij ® 76 | $1.2\times10^8$ | $3.2\times10^{10}$ |

EXAMPLE 6

This example illustrates the improvements in resistivity achievable with a binder comprising both a hydrophilic and a particulate material.

An antistatic composition was prepared by first mixing 3.6 gm of a latex comprising an aqueous dispersion of poly[styrene-co-N-(2-methacryloyloxyethyl)-N,N,N-trimethylammonium methosulfate (weight ratio 95/5)] (24.6 weight percent solids), and 4.4 ml of an aqueous solution of poly(ethylene oxide)(10%, molecular weight 1450, Eastman Kodak Company) and 0.2 ml Olin 10G® surfactant (10%, Olin Mathieson) with 30 ml water. To this dispersion was added 8.9 ml gelatin IV (10%, Eastman Kodak Company) and 3.3 ml of $LiBF_4$ (5% solution, Ozark-Mahoning Company). This dispersion was applied to a subbed poly(ethylene terephthalate) film support at a wet coverage of 24.2 ml/m$^2$, chill set at 2° C. and dried at 30° C. The resulting layer had a dry coverage of 1.15 g/m$^2$. The layer was clear, colorless and non-tacky. The surface resistivity was $2\times10^9$ ohm/sq at 20% relative humidity. The binder was a 1:1 mixture of the hydrophilic material gelatin and the particulate latex polymer.

EXAMPLE 7

A series of antistatic compositions was prepared as in Example 6. The amounts of poly(ethylene oxide) and $LiBF_4$ were the same as used in Example 6. The amounts of gelatin and the latex were varied in such a way that the dry coverage of the sum of the gelatin and the latex was constant and the same as used in Example 1. The resistivity and physical properties are shown in Table IV.

TABLE IV

| Weight % Latex in the Latex + Gelatin Mixture | Resistivity, ohm/sq at 20% RH |
|---|---|
| 0 | $2\times10^{10}$ |
| 37.5 | $3\times10^9$ |
| 50 | $2\times10^9$ |

This example clearly illustrates the reduction in resistivity achieved by a mixed binder of particulate hydrophobic and hydrophilic materials.

EXAMPLE 8

The antistatic composition of Example 6 was coated wet-on-wet simultaneously with a r:edical X-ray emulsion on a subbed poly(ethylene terephthalate) film support. Resistivity values of these coatings were $8\times10^{10}$ ohm/sq at 25% relative humidity and $4\times10^{10}$ 50% relative humidity. This example demonstrates that the antistatic compositions of this invention can be coated in simultaneous multilayer coating processes.

The invention has been described in detail with particular reference to preferred embodiments thereof, but it will be understood that variations and modifications can be effected within the spirit and scope of the invention.

We claim:

1. An antistatic composition comprising a binder and a nonionic surface-active polymer having polymerized alkylene oxide monomers and an alkali metal salt characterized in that the composition is heterogeneous, comprises on a dry basis, at least 7 weight percent polymerized alkylene oxide monomers and the binder is selected from the group consisting of a particulate material and a mixture of particulate materials with hydrophilic materials.

2. An antistatic composition comprising a binder and a nonionic surface-active polymer having polymerized ethylene oxide monomers and an alkali metal salt characterized in that the composition is heterogeneous, comprises on a dry basis, at least 7 weight percent polymerized ethylene oxide monomers and the binder is selected from the group consisting of a particulate material and mixtures of particulate materials with hydrophilic materials.

3. The composition of claim 1 or 2 comprising at least 7 weight percent polymerized alkylene oxide monomers; from 1 to 8 weight percent of the alkali metal salt; from 40 to 92 weight percent of the binder material and said binder contains from 40 to 67 weight percent of a hydrophilic material and 33 to 60 weight percent of a particulate material.

4. The composition of claim 1 or 2 comprising at least 7 weight percent polymerized alkylene oxide monomers, from 1 to 8 weight percent of the alkali metal salt and from 40 to 92 weight percent of the particulate material.

5. The composition of claim 1 or 2 wherein the particulate material is selected from the group consisting of hydrophobic latex polymers and inorganic colloid materials.

6. The composition of claim 1 or 2 wherein the nonionic polymer is a homopolymer or a copolymer.

7. The composition of claim 1 or 2 wherein the particulate material is selected from the group consisting of colloidal silica and acrylic latex compositions.

8. The composition of claim 1 or 2 wherein the nonionic polymer is selected from the group consisting of nonylphenoxypoly(ethylene oxide)ethanol, octylphenoxypoly(ethoxy)ethanol, poly(ethrylene oxide) ether alcohol, stearylpoly(ethylene oxide) and poly(ethylene oxide-block-propylene oxide) and the alkali metal salt is selected from the group consisting of $LiBF_4$ and $LiNO_3$.

9. An element comprising a support and a layer of an antistatic composition which comprises a binder and a conductive complex of a nonionic surface-active polymer having polymerized alkylene oxide monomers and an alkali metal salt characterized in that the composition is heterogeneous, comprises on a dry basis, at least 7 weight percent polymerized alkylene oxide monomers and the binder is selected from the group consisting of a particulate material and a mixture of a particulate material with a hydrophilic material.

10. A photographic element comprising a support having thereon a radiation-sensitive layer and a layer of an antistatic composition comprising a binder and a conductive complex of a nonionic surface-active polymer having polymerized alkylene oxide monomers and an alkali metal salt characterized in that the composition is heterogeneous, comprises on a dry basis, at least 7 weight percent polymerized alkylene oxide monomers and the binder is selected from the group consisting of a particulate material and a mixture of a particulate material with a hydrophilic material.

11. The element of claim 9 or 10 wherein the particulate material is selected from the group consisting of hydrophobic latex polymers and inorganic colloid materials.

12. The element of claim 9 or 10 wherein the particulate material is selected from the group consisting of colloidal silica and acrylic latex compositions.

13. The element of claim 9 or 10 wherein the nonionic polymer is selected from the group consisting of nonylphenoxypoly(ethylene oxide)ethanols, octylphenoxypoly(ethoxy)ethanol, poly(ethylene oxide) ether alcohol, stearylpoly(ethylene oxide) and poly(ethylene oxide-block-propylene oxide) and the alkali metal salt is selected from the group consisting of $LiBF_4$ and $LiNO_3$.

14. The element of claim 9 or 10 wherein the antistatic composition comprises on a dry basis, at least 7 weight percent polymerized alkylene oxide monomers; from 1 to 8 weight percent of the alkali metal salt; from 40 to 92 weight percent of the binder material and the binder material contains from 40 to 67 weight percent of a hydrophilic material and 33 to 60 weight percent of a particulate material.

15. The element of claim 9 or 10 wherein the antistatic composition comprises at least 7 weight percent polymerized alkylene oxide monomers, from 1 to 8 weight percent of the alkali metal salt and from 40 to 92 weight percent of the particulate binder.

* * * * *

UNITED STATES PATENT AND TRADEMARK OFFICE

CERTIFICATE OF CORRECTION

PATENT NO. 4,542,095

DATED September 17, 1985

INVENTOR(S) David J. Steklenski and Jan E. Littman

It is certified that error appears in the above-identified patent and that said Letters Patent are hereby corrected as shown below Col. 8, line 27 the part reading "poly(ethrylene oxide)" should read --poly(ethylene oxide)--.

Signed and Sealed this

*Seventeenth* Day of *December 1985*

[SEAL]

*Attest:*

DONALD J. QUIGG

*Attesting Officer*

*Commissioner of Patents and Trademarks*